US006986514B2

(12) United States Patent
Snow

(10) Patent No.: US 6,986,514 B2
(45) Date of Patent: Jan. 17, 2006

(54) POKER GAME PLAYED AGAINST MULTIPLE DEALER HANDS

(75) Inventor: Roger M. Snow, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 0 days.

(21) Appl. No.: 10/646,670

(22) Filed: Aug. 22, 2003

(65) Prior Publication Data

US 2005/0040599 A1 Feb. 24, 2005

(51) Int. Cl.
*A63F 1/00* (2006.01)

(52) U.S. Cl. ..... 273/292; 273/274

(58) Field of Classification Search ..... 273/292, 273/274, 309; 463/12, 13
See application file for complete search history.

(56) References Cited

U.S. PATENT DOCUMENTS 4,836,553 A 6/1989 Suttle et al.
4,861,041 A 8/1989 Jones et al.
5,154,429 A * 10/1992 LeVasseur ..... 273/292
5,255,915 A 10/1993 Miller
5,382,025 A 1/1995 Sklansky et al.
5,678,821 A * 10/1997 Hedman ..... 273/292
5,685,774 A 11/1997 Webb
5,697,614 A 12/1997 Potter et al.
5,839,731 A 11/1998 Feola
5,845,906 A 12/1998 Wirth
5,851,011 A * 12/1998 Lott ..... 273/292
5,897,436 A 4/1999 Singer et al.
5,951,011 A * 9/1999 Potter et al. ..... 273/292
6,012,719 A 1/2000 Webb
6,027,119 A 2/2000 De Lisle
6,062,565 A 5/2000 Chadband et al.
6,155,568 A 12/2000 Franklin
6,170,827 B1 1/2001 Lombardo et al.
6,206,373 B1 3/2001 Garrod
6,234,485 B1 5/2001 Perkins
6,237,916 B1 5/2001 Webb
6,332,614 B1 * 12/2001 Hesse ..... 273/292
6,474,646 B1 11/2002 Webb
6,511,068 B1 1/2003 Sklansky et al.
6,533,279 B2 3/2003 Moody et al.

* cited by examiner

*Primary Examiner*—Benjamin Layno
(74) *Attorney, Agent, or Firm*—Mark A. Litman & Associates, P.A.

(57) ABSTRACT

A method of playing a casino table poker-type game comprises a player placing an Ante wager on the poker-type game. The dealer provides at least one hand to the player placing the wager on the poker-type game and at least two hands to the dealer. The player elects to a) fold, b) place a wager to compete against less then all dealer hands, or c) placing a wager to compete against all dealer hands. After the election has been made by the player, the dealer discloses all of the dealer's at least two hands. Wagers made in accordance with b) and c) are resolved.

8 Claims, 1 Drawing Sheet

POKER GAME PLAYED AGAINST MULTIPLE DEALER HANDS

BACKGROUND OF THE INVENTION

1. Field of the Invention

The present invention relates to poker variants and casino table poker games in which a player competes against a dealer for payouts on wagers. In particular, the present invention relates to casino table poker games that provide a player with an enhanced perception of player advantage and offers a fast-paced game with player strategy against multiple dealer hands.

2. Background of the Art

Numerous card games systems have been developed for gaming and entertainment purposes. Many of these card games systems have been adapted for use in casino wagering card games, such as blackjack and poker, to name a few. The development of successful casino card games must address several distinct criteria.

As with all successful games, a successful casino card game must be entertaining for the players and offer an apparent chance for success at the game. To be sufficiently entertaining, a card game must balance often-competing factors. These factors include complexity and challenge of game play, the pace of game play, the element of chance, the level of player skill and strategy, the amount of player interaction, the number of wagers at stake and the apparent chance of success and strategic decision making by the player.

Aside from the effect on the entertainment value of the game, the complexity of game play is of practical importance to casino type wagering games. Overly complex rules of game play will prevent the attraction of new players to a casino game and might even frustrate players familiar with the game. Simple rules allow the game to be easily accessible to all. However, overly simplistic game play often results in an unchallenging and unentertaining game, and fails to attract more experienced players. It is well known that more experienced players make larger wagers.

The pace of game play is also of unique importance for a successful casino game. The rapid turnover, or cycle time, in the wagering rounds is preferred by the house in a casino game to maximize the wagering cycles of the game. This must also be balanced against how the pace of the game play affects the entertainment offered by the game. In other words, at some point, increasing the speed of the game past a certain point will reduce the entertainment value of the game. Some players feel pressured if the game moves too fast.

Regarding the element of chance, it is fundamental to casino type games that the element of chance plays a substantial role in the game. The player preferably would like to feel that some control can be exercised by players to enhance their chance of winning. At the same time, a game based solely on skill in making strategic decisions may tend to intimidate new players in a casino game environment. Additionally, if skill could be exercised that would actually shift statistical advantage in favor of the player, casinos would not offer the game. However, in most casino card games, winning is based on a combination of skill and the element of chance, where a player's increased skill will increase his likelihood of winning for short periods during repeated play. Consequently, the element of chance and the level of player skill and strategy necessary are both of importance in player perception and the casino's ability to offer the game.

Many different variations in the play of casino table poker games have been offered to provide a wide range of game play and maintain player interest in table games. There is some general knowledge or unpublished knowledge in the art that is not directly related to the play of the game that should be considered. These include the basic game of Pai Gow Poker, "Over/Under 21," Three-Game Poker variations and a patent Application filed by Shuffle Master, Inc. on May 13, 2003 and publicly shown by Shuffle Master, Inc. in March of 2003.

Pai Gow Poker

This game and it variants compel both the players and the dealer to form at least two distinct hands, a five-card High Hand and a two-card Low Hand. The player High Hand competes against the dealer High Hand and the player Low Hand competes against the dealer's Low Hand. Both of the Player's hands must beat both of the dealer's respective High and Low hands to win. There is a three hand Pai Gow variant shown in U.S. Pat. No. 6,474,646. Again the similarly ranked player hands (High, Mid and Low) each are playing against only one of the dealer's (High, Mid and Low) hands at a time (High vs High, Mid vs Mid and Low vs Low). The players are required to play all three hands against the dealer's three hands. The player's high, mid and low hands compete against the dealer's high, mid and low hands, respectively.

Over/Under 21

In this game, the player makes an optional side bet wager as to whether the count of the dealer's first two cards in the game of Twenty-One will be over 13 or under 13. This is a one-to-one wager. This game is played concurrently with the game of Twenty-One. The side bet is usually resolved prior to the dealer dealing players additional cards.

Oklahoma Stud™ Poker

In this game, the dealer is provided with two separate hands of cards, but only a single dealer hand is in play. A dealer's first hand is automatically discarded when the rank of the first hand exceeds a first predetermined minimum rank (e.g., a flush).

Lombardo et al. U.S. Pat. No. 6,170,827 B1 describes a casino table card game in which a greater number of cards are provided to a dealer than to a player. The player provides a first stake and designates a portion of his lesser number of cards to correspond to that first stake. The cards dealt to a player (e.g., 4 initial cards) are split into two hands, each of which has a separate stake, and each of which plays against two hand segments established by the dealer. The player may also rearrange cards in the first segment, but only if the player's hand ties the dealer's hand.

Webb U.S. Pat. No. 6,237,916 (assigned to Shuffle Master, Inc.) discloses the basic play of 3-Card Poker. The game is a method of playing a three-card poker card game, comprising the steps of: receiving a first wager that a player's three-card hand will exceed a dealer's three-card hand; receiving an optional second wager that said player's three-card hand will be at least a first predetermined rank; dealing a single hand of only three cards each to said player and to said dealer; receiving an optional third wager from said player. Iif the third wager is not received, the player forfeits said first wager and any said second wager. The method further includes the step of determining whether said dealer's three-card hand is at least a second predetermined rank. If the dealer's three-card hand is not at least said second predetermined rank, paying the player an amount based on said first wager and returning the third wager to the player. If the dealer's three-card hand is at least said second predetermined rank, comparing the dealer's three-card hand with the player's three-card hand. If the player's three-card hand is higher, the player is paid an amount based on both the first and third wagers. If the player's three-card hand is lower, the player forfeits both the first and third wagers. The player is paid an amount in accordance with a predetermined scale when said second and third wagers are received and the player's three-card hand is at least said first predetermined rank. There is no fourth bet and there is no second "dealer hand" or bonus hand in an accelerated bonus event. This is a three-card poker game only, not 2-cards, and there is only one dealer hand.

Moody U.S. Pat. No. 6,533,279 describes a variant of Three-Card poker. An initial hand of three cards is dealt to each player and three community cards are dealt face down in front of the dealer. The player decides which cards to hold and which cards to discard. For each card that is discarded, the player uses one of the community cards as the replacement card. If the player discards one card, Card #1 is used as the replacement card. If the player discards two cards, Card #1 and Card #2 are used as the replacement cards. If the player discards all three cards, Card #1, Card #2 and Card #3 are used as the replacement cards. After the player has made his decision, all of the community cards are turned face up and the outcome of the player's final three card hand is determined. Winning and losing outcomes are determined based on a pay table and the amount of the player's wager. There are never two or more dealer hands.

Suttle et al. U.S. Pat. No. 4,836,553 and Jones U.S. Pat. No. 4,861,041 describe the basic play of Caribbean Stud® poker. A five card hand is dealt to each player after a mandatory ante bet is placed and five cards are also dealt to a dealer. Prior to dealing cards, the player may place an optional side bet to participate in the jackpot component of the game. One card from the dealer's hand is exposed, and the player may place a play wager that is a multiple of the ante (typically 2× the ante) to stay in the game after viewing the dealer's partially disclosed hand (e.g., the single up card). Bonus bets are paid in this game, only when the player attains a ranked hand and beats the dealer's hand. There is only a single dealer hand. The dealer must also qualify, typically with a Queen high or better for the player to win a bonus payout on the play wager.

Webb U.S. Pat. No. 5,685,774 describes a casino table poker game in which separate bets may be placed by a player that a player's hand will either exceed a predetermined rank or beat the dealer's hand. At least one, but not necessarily both bets may be placed. A third optional bet is available that backs up the wager as to whether the player's hand will exceed the rank of the dealer's hand. Wild cards are available, and an initial hand of four cards may be dealt to the player. There is only a single dealer's hand.

Webb U.S. Pat. No. 6,012,719 describes a variant of mixed card games which combines the play of Blackjack, a three-card poker wager, and a side bet. A dealer's card is combined into the player's first two cards for the three-card poker play. The dealer's hand has no effect on bonus events. There is only a single dealer hand in play.

Lott U.S. Pat. No. 5,851,011 describes a poker-type game with multiple wagers, jackpots and insurance options. Multiple players wager on a single five-card player hand which competes against a seven card dealer hand from which five dealer cards are selected to form a dealer's hand. There is only a single dealer hand in play.

Sklansky et al. U.S. Pat. Nos. 6,511,068 and Sklansky et al. U.S. Pat. No. 5,382,025 describe a casino table card game in which multiple hands (three hands) are provided face-up to the table, not to a player, along with face-down common cards. Players make individual wagers as to which of the multiple hands will produce the highest rank in combination with the common cards when the common cards are revealed. More than one player can bet on a hand, and each player can bet on only one hand. There are no possibilities for a player to wager against the three hands, players do not get individual hands, and there are no optional side bets for high ranking hands.

Franklin U.S. Pat. No. 6,155,568 describes a poker-type game in which an initial 7-Card hand is provided to players and the dealer. The initial 7-Card hand is broken down into three poker hands, a 2-Card low hand, a 2-Card middle hand, and a 3-Card high hand. The player must win at least two of the competitions of Low vs Low, Middle vs Middle, and High vs. High hands. Tie rankings are in favor of the dealer. There are no options for the number of hands in play, and the player must play with three hands.

Chadband U.S. Pat. No. 6,062,565 provides the ability of a player at a casino table card game to make separate wagers on separate two-player hands. Players may elect to play either the frontline hand or the backline hand against jackpots built up among players. There are no multiple dealer hands.

Potter et al. U.S. Pat. No. 5,697,614 describes a casino table card game in which multiple bank hands are provided to the table on which players may make wagers in multiple games. There is no dealer actively playing a house hand and no player hand is competing against multiple dealer hands.

Feola U.S. Pat. No. 5,839,731 describes a method for playing a casino table card game (including stud poker variants) in which a number of hands are dealt in a line, and players wager as to which hand will win. A selected hand may be playing against the house or against all other hands, but outcome is not dependent upon the selected hand beating more then one hand.

Jones et al. U.S. Pat. No. 4,861,041 describes an optional side bet made on bonus play in table games, specifically in Caribbean Stud® poker. With placement of a side bet, bonus hands are rewarded, even if the dealer beats the ranked hand of a player or does not qualify with a minimum hand ranking.

De Lisle U.S. Pat. No. 6,027,119 describes a method of playing a card game (non-poker type) wherein players' and dealer's hands are valued by determining the suit (in each hand) where the player's and dealers 'points' are highest. There are optional call bets at various points of hand disclosures.

Singer U.S. Pat. No. 5,897,436 describes a modified poker game in which a player builds a hand, being dealt two cards at a time and discarding one card at a time, until a hand is built of a predetermined number of cards.

Garrod U.S. Pat. No. 6,206,373 B1 describes a method of playing a card game with a dealer's hand that has a 'permanent displayed card (e.g., the Ace of Spades). From the remainder of the deck, each player is dealt two face-down cards, and each player may act on their cards, being given an option to continue or fold and receive a portion of the wager back. Then five common cards are dealt face up, with the common cards being common to both the dealer's and the players' hands. Players may receive awards for bonus hands.

Perkins U.S. Pat. No. 6,234,485 allows a player to purchase a bonus card in the play of a casino table poker game, the card being delivered when the first five cards is a losing hand.

Wirth U.S. Pat. No. 5,845,906 teaches the potential for the option of using a sixth card in a dealer-vs.-player casino table five card poker game.

Miller U.S. Pat. No. 5,255,915 describes an electronic six card poker hand, with an option of drawing cards available, and an optional sequence of wagers.

Shuffle Master Inc.'s U.S. patent application Ser. No. 10/277,508 describes a game in which a Player may get additional cards when the player's hand has a low value. This activity does not require a side wager.

In spite of the availability of many casino table card games in the literature, only a few games have been widely successful in the casino gaming market. It is therefore desirable to provide a greater variety of games from which more successful table games can be found.

SUMMARY OF THE INVENTION

A method of playing a casino table poker-type game is disclosed. The method comprises the step of a player placing an Ante wager to participate in a poker-type game. The dealer provides at least one hand of cards to each player participating in the poker-type game. According to the method, the dealer provides at least two hands of cards to the dealer. The player may elect to a) fold, b) place a Play wager to compete against less then all dealer hands, or c) place a wager to compete against all dealer hands. After the election, the dealer discloses all of the dealer's at least two hands. Wagers made in accordance with b) and c) are then resolved. In one example of the invention, each player receives a single two card hand and the dealer receives three separate hands, at least two of which are two-card hands. The third dealer hand may comprise two or more cards and the dealer may play the best two cards. In this example, wager b) is made on beating two out of three hands. In one example of the invention, payouts of 1:1 are made on the bet, and payouts of 1:1 are made on option b) and 3:1 on option c).

A method of playing a casino table card game is described wherein a player makes an ante wager and elects to make an optional bonus wager. The player is paid a first amount for a predetermined hand on the bonus wager when the dealer qualifies and is paid a second amount for a predetermined hand on the bonus wager when the dealer hand rank does not qualify in the casino table card game. According to the invention, the first amount is different from the second amount, and neither the first amount or the second amount is zero. In one example of the invention, the player is paid an enhanced payout of 2× the posted odds for winning bonus hands when the dealer does not qualify.

A method of playing a casino table poker-type game is described comprising the steps of: 1) a player placing an Ante wager on the poker-type game; 2) the dealer providing one hand to the player placing the wager on the poker-type game; 3) the dealer providing three hands to the dealer; 4) the player electing to a) fold, b) place a Play wager to compete against the lower two ranked hands in the dealer hands, or c) placing a wager to compete against all three dealer hands; 5) disclosing all of the dealer's three hands; and 6) resolving wagers made in accordance with b) and c) according to the rules of the game.

DETAILED DESCRIPTION OF THE INVENTION

Figure 1:
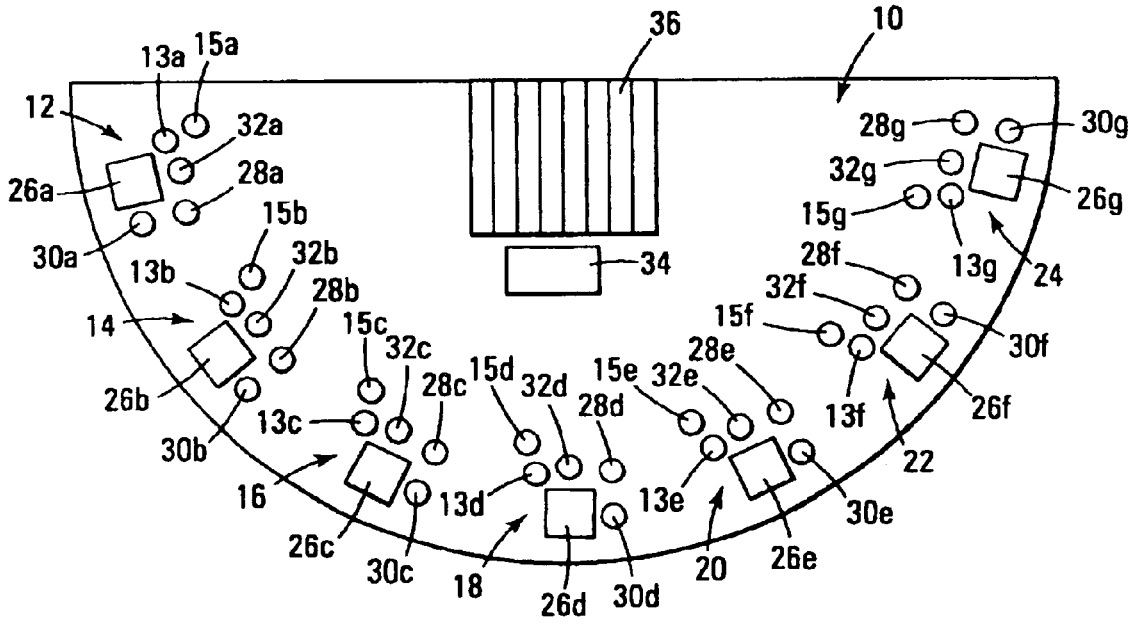
FIG. 1 is a top plan view of a playing surface for playing a casino card game of the present invention.

The play of a preferred embodiment of the underlying Two-Card Poker™ game is described below. The rules of the basic Two-Card Poker™ game are adapted from well known rules of poker, where the player competes against the dealer in poker rank. The rankings in a game of two card poker of the present invention are slightly different, as straights and flushes appear too frequently to be considered winning outcomes. The winning ranks in 2 card poker are (high to low) straight flush, pair and high card. The variations in the combination of hands with this game will be described in greater detail, below. The game may be described generally as having the following features:

1) The player may place at least two initial wagers in the play of the present invention: an Ante Wager and at least one Optional Side Bet wager. The player may also play 'blind' and make both an ante wager and a play wager before viewing the cards.
2) After the player has placed at least the Ante wager, the dealer deals himself multiple hands (two or three dealer hands being the preferred number of hands) and the player is dealt a single hand. In one form of the invention, the dealer receives three hands of two cards each and the players each receive one two-card hand. In another form of the invention, at least one and preferably only one of the dealer's hands includes one or two more cards than the remaining hands. The extra cards are discarded to make a best hand of the same number of cards as the remaining hands.
3) The player then looks at the player's hand and must decide whether to a) fold, b) make a first Play Bet that the player's hand will beat fewer than all of the dealer's hands (in the preferred game the player's hand must beat the dealer's worst two hands, the low and middle hands), or 3) make a second Play Bet that the player's hand will beat all of the dealer hands. When one of the dealer hands has more than the stated number of cards, the dealer must discard cards to make the best hand. When the number of cards in each hand is 2, and the dealer deals himself one hand containing more than 2 cards, the dealer discards a card or cards to make the best two-card hand. Although in one form of the invention the number of cards in each of the players and dealer's hands is 2, other card counts are contemplated, such as a three or four card hand. The poker rankings would necessarily be more complex when the number of cards per hand is increased.
4) The Play Bet generally must be at least equal to the ante bet (although a smaller proportional wager or absolute amount wager, e.g., 50% or $5.00, is contemplated), but may vary in relationship to the particular Ante with which the Play Bet is associated. For example, the first Play Bet with the first Ante may be 2× the first Ante and the second Play Bet associated with the second Ante may be 3× the second Ante. The Play Bet may also be limited to a required or only 1×, 1.5×, 2×, 3× or other multiple of the Antes. Thus, the game rules may require specific bets in proportion to the Ante to allow the Player to continue in the game.
5) The dealer then arranges each of the hands separately in the order of rank, high hand to low hand, without intermingling cards between hands. Extra cards in a dealer hand or hands must be discarded so that all three dealer hands have the same number of cards.
6) The players' hands and dealer's hands are then compared according to the wager made.
7) The payout on the Ante and the Bet for beating the next to the highest hand (which is the middle-ranked hand when the dealer has three hands, and that the low and middle hands are beaten) is 1:1. If the player wagers on beating all (three) hands and beats the high hand (meaning the player has beaten all of the hands), a higher payout, for example 3:1 or 4:1, is made on the bet, and even money is paid on the Ante. Other payout amounts are also contemplated, such as 3:1 or 2:1 on the Bet.

8) The dealer must qualify with a hand rank of 6-High or better in preferably each and every dealer's hand, at least two dealer's hands or at least one dealer's hand to play. When the dealer doesn't qualify, the rules may exclude all activity on both the Ante and Play Wagers, but the side bets are in play. The rules may also allow for only the Ante Wager, or only the Play Wager to be in play when the dealer doesn't qualify.

9) When the dealer doesn't qualify, the Ante and Play bets are preferably a push, even if the dealer's low hand is higher then the player's hand.

10) When the dealer doesn't qualify, and the player has made an optional bonus bet, the player may be automatically paid enhanced odds on winning hands in the bonus bet (e.g., 2× normal odds on a paytable of posted odds and corresponding winning combinations for the bonus bet).

As can be seen from the prior art, there are significant differentiating points of novelty between the Two-Card Poker™ game with side bet bonus and the games described by the prior art. Among these differences are:

1) A casino table card game with a single player hand (especially 2-Cards) simultaneously required to play against multiple dealer hands—at least two and typically three dealer hands.

2) A casino table card game with a single player hand (especially 2-Cards) simultaneously required to play against multiple dealer hands, with an option of how many hands the player will compete against, the minimum being one when the dealer holds two hands.

3) A casino table card game with a single player hand (especially 2-Cards) simultaneously required to play against multiple dealer hands in a predetermined order of arrangement of rank in the dealer hands.

4) A casino table card game with a single player hand simultaneously required to play against multiple dealer hands, when at least one dealer hand has more cards than the remaining dealer hands and player hand, and when the dealer discards cards to make the card count of each hand equal to the card count of the player hands.

5) An automatic increase or enhancement in the return on the bonus wager payout dependent of player hand rank when a dealer's hand does not qualify. Qualification may be a single specific rank for all of the dealer's hands (e.g., 6-high in each hand) or may be graded, such that the second hand (middle hand) must be at least 6-high and the high hand must be at least 7-high).

In an exemplary two-card game against three dealer hands of the present invention, winning hand rankings are as follows: Straight flush, pair and high card. Straights and flushes are not winning rankings in this game, as they would appear 1/6.2 times and 1/4.2 times, respectively. When the player beats the next to the highest dealer hand, he is paid 1:1 on the bet and the ante. When the player plays against the dealer's highest hand and wins, in one example of the invention the player wins 1:1 on the ante and is paid an enhanced payout, such as 3:1 or 4:1 on the bet. Other enhanced payout amounts, such as 2:1. 3:1, 3.5:1 or 5:1, for example are contemplated.

For certain high ranking hands, the player may win a bonus amount when the bonus wager is made. A typical pay table for the bonus bet is:

Side Bet Bonus Payouts

| Hand | Payout |
|---|---|
| Mini Royal (AK suited) | 20:1 |
| Straight Flush | 5:1 |
| Pair | 4:1 |
| Ace High | 1:1 |

Winning Hand Ranking on the 2-card poker ranks and bonuses are Ace-King suited, straight flush, pair and high card. If a player made a side bet on his hand and the dealt hand was a straight flush, according to the pay table above, the player would win 5:1 on the bonus bet.

A side bet such as at least an Ace high bet is a side bet against a pay table. The pay table is a compilation of winning arrangements of cards and corresponding payout odds. Typically the pay table lists winning hand arrangements in descending order.

Payouts on the side bet are independent of the relative rank between a Player's hand and the Dealer's hands. When the Player has made the side bet and is dealt a hand with a rank of an Ace or higher, the Player is paid odds or enhanced odds on the amount of the Ace High wager, depending on whether or not the dealer qualifies. According to the invention, enhanced odds are paid out when the dealer does not qualify. In another example, the minimum winning hand may be a King high, a Queen high, a Jack high or combination minimum, such as Jack-10 minimum or 10,9 minimum. The amount of the side bet wager may be placed independently up to the Table Limit or at a fixed table amount or table range.

A unique feature of the method of the present invention is when the dealer does not have a qualifying hand. Typically the player may not play any wager (the ante may be paid off) against the dealer unless each of the hands dealt (all three of the hands) is of a minimum qualifying rank, such as a 6 high or better, for example. When the player has made the bonus bet and has a qualifying bonus hand, but none of the dealer's hands qualify, according to the invention the player still is paid an enhanced bonus payout. One example of an enhanced payout is double the posted odds on the bonus pay table. In other examples, the payout odds are enhanced by more or less than double the payout odds, or the odds are enhanced by adding a fixed sum or paying a jackpot amount such as a progressive jackpot amount. If for example, the player holds a pair of Aces, and the dealer does not qualify with all three of his two card hands, the player is paid twice the posted odds of 4:1, that is, paid at 8:1. In other examples of the invention, if at least one but not all of the dealer's hands qualify, the player qualifies for an enhanced bonus payout amount.

It is important to note that according to one alternative aspect the invention, all of the dealer's hands must qualify or the player cannot compete against the dealer. When the dealer does not qualify (e.g., does not qualify in all hands or in two hands, or in one hand according to house rules), the Ante and Play bets are a push. The bonus bet is resolved independently of the play in the bonus game. In one example of the invention, payout odds are enhanced on the bonus game when none of the dealer's hands qualify.

In another example of the invention, the dealer deals each player a two-card hand and deals himself two two-card hands and one three or four-card hand. After the players have viewed their cards and either folded or placed a play bet, the dealer makes his best two-card hand with the three or four card hand and then arranges his three hands in rank order.

This rule increases the house advantage, as it gives the house the opportunity to improve at least one hand of cards. In other forms of the invention, the dealer deals himself more than the stated number of cards in more than one hand.

Other variations in the game are possible based on the above-described play of a preferred version of the game of the invention exemplified by the described Poker game. For example, after step 3), the player may be allowed to surrender a portion of the player's ante, for example half the ante rather than fold. Variations in the amount of the play wager (e.g., from 1× to 1.5×, 2×, 2.5×, 3× and more) maybe allowed, either as a fixed wager required or at the option of the player.

EXAMPLES

Example 1

A table 10 similar to a standard blackjack table is provided as shown in FIG. 1. There are seven player positions, 12, 14, 16, 18, 20, 22 and 24 and one dealer position. At each player position there is an area for receiving cards 26*a–g*, an area 28*a–g* for placing one Ante Wager, an area 30*a–g* for placing a Play wager, and an area 32*a–g* for placing a side bet bonus wager on the above described optional bonus wager. The minimum ranking bonus hand in this example is a Queen high, which pays 6:1. The first two players (in areas 12 and 14) place a $5.00 on Ante Wager areas 28*a–b* and $5.00 Bonus on areas 32*a–b* for placing side bets. The second two players (in areas 16 and 18) place $5.00 Ante Wagers on areas 28*c–d* and do not place side bet wagers. No players are present in areas 20, 22 and 24.

The dealer is dealt three distinct hands of two (2) cards in each hand, all cards being face down in area 34 in front of chip tray 36 and each of the players is dealt two (2) cards face down into areas 26*a–d*. The cards are dealt in batches of two cards to each player and six cards to the dealer, preferably in sets of two (2) cards for each hand after all initial wagers are placed (the Ante and the side bet). The players can examine their cards at this time. It does not actually matter (as far as individual players are concerned) whether player cards are exposed or not, but to limit player knowledge of potential cards in the dealer's hand, the player cards remain face down and unexposed to other players.

The players examine their hands and determine whether their strategy will be to fold their hand, make a play wager that their hand will beat two of the dealer's hands (it will be assumed that it must beat the lowest two hands in this Example), or make a play wager that their hand will beat all three of the dealer's hands.

The first player in position 12 examines his two card hand, finds there is a pair (e.g., six of Hearts and six of Clubs) in that player's hand, decides to remain in play of the game, and places a $5.00 Play Wager that he will beat all three dealer hands on the table. A distinct wager area 15 is provided for the Beat-Three wager.

The second player in position 14 examines his two card hand, finds there is a King High hand rank (e.g., King of Clubs and three of Diamonds) in that player's hand, decides to remain in play of the game, and places a $5.00 Play Wager on the table in the special location 13*b* for the Beat-Two wager.

The third player in position 16 examines his two card hand, finds there is a 10-high rank in the hand (e.g., 10 of Hearts, and 6 of Clubs) in that players hand, decides to remain in play of the game, and places a $5.00 Play Wager on the table to play Beat-Two wager at position 13*c*.

The fourth player in position 18 examines his two card hand, finds there are no pairs or any hands of winning rank, decides to withdraw from play of the game, and places no Play Wager on the table. The fourth player loses his Ante and would have lost the bonus bet, if it had been made.

The dealer then confirms that all player decisions have been made and then turns the three dealer's hand over to expose all cards to the table, revealing the three 2-card hands that have been face down until this point. The dealer's hands, in descending order are found to be a pair of sevens hand, a Queen high hand (Queen of Clubs and 3 of diamonds), and a 10-high hand (10 of clubs and 4 of diamonds). The dealer arranges the three dealer's hand on the table so that all player's can view the cards and then proceeds to arrange player hands one at a time to evaluate their highest rank against the dealer's three hands. The wagers against the Beat-Three bet may be examined first. Only one player (Player 1) made that wager.

The first player hand with a pair of sixes is displayed, the player loses the Ante and Play wagers on the Beat-Three bet, since his pair of sixes did not beat all three hands of the dealer, losing to the dealer's high hand on a pair of sevens. The player made a wager on the side bet, and is therefore paid 4:1 on the wager, therefore losing $10.00 on the underlying game, but winning $20.00 on the side bet. The player hand at the first position 12 is then removed and placed into a discard pile or rack. The dealer then moves to the second player hand.

The second player hand of King high at position 14 wins the Beat-Two wager, and wins the side bet wager. The Player 2 is therefore paid $10.00 (1:1) on both the Ante and Beat-Two wagers and $5.00 on the side bet (1:1) wager. The second player hand is the removed from the table by the casino.

The third player hand is 10-high and loses the Beat-Two wager, losing the Ante and Play bets and did not place a Queen High side bet. The third player hand is removed from the table. He loses $10.00 in the round of play.

The fourth player hand had already been removed, so it is not in play. The dealer then shuffles the cards and another round of play is engaged.

Example 2

In this Example, there are again only four player positions in play for purposes of simplifying the Example. Player 1 places a $10.00 Ante and $5.00 Queen-High side bet; Player 2 places a $10.00 Ante and $10.00 Queen-High side bet; Player 3 places a $5.00 Ante and no side bet; and Player 4 places a $5.00 Ante and no side bet. Again, each player is dealt two cards face down and the dealer is dealt two sets of 2-cards hands, and one set of a 3-card hand, face down.

Player 1 examines the Player 1 hand and finds a straight flush of 2 of Hearts and 3 of Hearts. He places (what is defined by the rules at this particular table) a maximum play bet of 2× the Ante or $20.00 to Beat-Three, or beat all three hands of the dealer.

Player 2 examines the Player 2 hand and has a pair of Kings, and bets only $5.00 to Beat-Three, that is beat all three dealer hands.

Player 3 examines the Player 3 hand and finds a Jack-high hand. Player 3 makes a Beat-Two wager of $5.00 Player 4 has a hand of rank 7-high and folds.

The dealer then confirms that all player decisions have been made and then turns the three dealer's hand over to expose all cards to the table, revealing two 2-card hands that have been face down until this point. The three card hand is also revealed, and one card is discarded to form the best two-card hand. The dealer's hands are arranged in descending order and are found to be 6-high, 5-high and 4-high. This Bust-Three hand effectively does not qualify the dealer's hand for Ante Play and Play Wager competition, so all Ante and Play wagers are a push. However, because the three dealer hands did not exceed a rank of 6-high, a special bonus is in play for the Queen-High bonus bet. Not only are those bonus bets paid off, but they are paid off at an enhanced rate of 2× the normal pay table. Player 1's Queen-High side bet of $5.00 is paid off at 2× 5:1 or 10:1 (for obtaining a straight flush) and Player 1 receives $50.00 on the Queen-High side bet.

Player 2 made a $10.00 side bet wager and had a pair. That side bet wager is therefore paid off at 2× of 4:1 or 8:1, or $80.00.

Player 3 holds a Jack high, and beats the dealer's middle and low hand. The player receives only $5.00 against the Ante and Play wagers. If Player 3 had made a Queen-High wager, that wager would have been collected by the casino as the Player 3 hand was lower than Queen-High.

Although specific examples and features have been described, alternative embodiments are within the skill of the artisan for use with the underlying game of the invention. Wild cards may be added, and additional side bets may be made on the game, such as wagering how many dealer hands will exceed Queen-High hands. The dealer may be required to disclose at least one card from the six dealer cards that are initially provided, with or without initial arrangement of dealer hand ranks. This can actually be quite a deceptive element to the game, as the dealer can reveal a 2 in the highest ranking hand, and the hand could theoretically have any rank between a pair and a 4-high hand.

What is claimed:

1. A method of playing a casino table poker-type game comprising:

a player placing an Ante wager on the poker-type game;

the dealer providing one hand to the player placing the Ante wager on the poker-type game;

the dealer providing three hands to the dealer which are initially dealt dealer hands;

the player electing to a) fold, b) place a wager to compete against a lower two poker ranked hands in the dealer hands, or c) placing a wager to compete against all three dealer hands as poker hands; and disclosing all of the dealer's three hands; and resolving wagers made in accordance with b) and c) wherein each of the dealer's three hands must be of at least a minimum predetermined rank in order to play against the player or players.

2. The method of claim 1 wherein the minimum predetermined rank is a 6 high rank.

3. The method of claim 1 wherein the player elects one of step a, b or c after being provided with an opportunity to view the player hand.

4. The method of claim 1 wherein the wager made in step b or c is equal to the ante.

5. The method of claim 1 wherein the wager made in step b is a multiple of the ante.

6. The method of claim 1 wherein payout odds on step b if made is 1:1 and payout odds on step c if made is 3:1.

7. The method of claim 1 and further comprising the step of placing an optional side bet on one of a predetermined winning hand combinations, wherein if the dealer does not qualify and the player has made the optional side bet and has obtained a predetermined winning hand combination, the player is paid an enhanced award.

8. The method of claim 7, wherein the enhanced award is 2× a posted payout amount.

* * * * *